United States Patent [19]

James

[11] 4,167,098

[45] Sep. 11, 1979

[54] HORIZONTAL PUMPING UNIT

[76] Inventor: Robert G. James, 3509 Janene Way, Bakersfield, Calif. 93306

[21] Appl. No.: 842,583

[22] Filed: Oct. 17, 1977

[51] Int. Cl.[2] ..... F15B 15/18

[52] U.S. Cl. ..... 60/369; 60/372; 60/378; 60/413

[58] Field of Search ..... 60/369, 371, 372, 378, 60/413, 414, 415; 91/196; 92/137

[56] References Cited

U.S. PATENT DOCUMENTS

| | | | |
|---|---|---|---|
| 1,848,736 | 3/1932 | Mason | 60/372 |
| 2,390,124 | 12/1945 | Ross | 60/372 |
| 2,802,336 | 8/1957 | Ball | 60/371 |
| 3,230,711 | 1/1966 | Swain et al. | 60/371 |
| 3,782,117 | 1/1974 | James | 60/372 |

FOREIGN PATENT DOCUMENTS

| | | | |
|---|---|---|---|
| 1086470 | 8/1960 | Fed. Rep. of Germany | 60/369 |

*Primary Examiner*—Edgar W. Geoghegan
*Attorney, Agent, or Firm*—I. Michael Bak-Boychuk

[57] ABSTRACT

A horizontally exposed pumping unit including a hollow base structure containing a volume of hydraulic fluid and compressed air, the base structure supporting a horizontally aligned reciprocating piston assembly deployed for horizontal translation along a support track formed thereon. The piston assembly terminates at the free end in a roller attached to the cylinder structure, the piston rod in turn being secured to yet another fixed roller. A sheave chain connected to the cylinder exterior passes around the rollers to be played out along the track, the chain being turned around the translating roller to a guide roller deployed above an oil well. The articulation of the piston assembly is achieved by way of an electrically driven hydraulic pump communicating between the hollow base structure and the cylinder. Two reversing switches are deployed within the track to change the direction of the hydraulic pump according to the stroke position of the piston assembly. In addition two single action pistons are adjustably deployed at the ends of the cylinder stroke for transferring hydraulic fluid in or out of the hollow base structure to compensate for the variations in the pneumatic spring.

12 Claims, 3 Drawing Figures

HORIZONTAL PUMPING UNIT

BACKGROUND OF THE INVENTION

1. Field of the Invention

The present invention relates to oil well pumping units, and more particularly to hydraulically operated pumping units of the reciprocal kind.

2. Description of the Prior Art

Most commonly, extraction of underground oil is achieved by way of the walking beam pump system. This system, while mechanically large, provides one of the more accepted techniques in the art. In the recent past, however, various other techniques have been developed, including techniques in which hydraulic power is utilized to reciprocate the pump. For example, in my prior U.S. Pat. No. 3,782,117, I have set out a vertical, hydraulically operated, pumping system useful in oil well applications. The advantages of hydraulic power have thus been recognized, such systems providing the convenience of compact size as well as the convenience of shaping the power stroke to obtain optimum efficiency. Because of some frictional losses during the stroke and the drop-off in efficiency of hydraulic system with volumetric ratio such hydraulically operated pumping units often utilized pulley multiplication in order to obtain the stroke length necessary for extracting oil with reduced piston motion. This pulley multiplication heretofore has required large support structures which, similar to the walking beam pumps, presented an undesirable feature in the otherwise uninterrupted landscape. Furthermore the deployment of an oil well is typically vertical and consequently the stroke requirements are vertical, once more necessitating large vertical structures in the past.

It bears emphasis that the reciprocal motion of the pump can be exchanged into stored energy with the result that only the power necessary to lift the underground fluid is the power demanded on the system.

SUMMARY OF THE INVENTION

Accordingly, it is the general purpose and object of the present invention to provide a horizontally deployed hydraulic pumping system utilizing pneumatic compression for the counterbalance of the pumping stroke.

Other objects of the invention are to provide a hydraulically operated well pump unit which by virtue of its arrangement of parts is deployed in a horizontal alignment.

Yet further objects of the invention are to provide a hydraulically operated pumping system adapted to reciprocate a piston assembly for articulating an underground pump.

Yet additional objects of the invention are to provide a pneumatically counterbiased pumping system which, according to the stroke, is self compensating.

Briefly, these and other objects are accomplished within the present invention by providing a substantially toroidal accumulator cavity which concurrently functions as the base of the pump. By virtue of this arrangement the temperature of the accumulator is substantially equal to the temperature of the ground on which it rests, thus providing a relatively stable thermal environment. Included within this toroidal accumulator is a volume of hydraulic fluid with the ullage comprising gas at a predetermined level of compression. It is this compressed gas that provides the spring bias opposing the weight of the downbore pumping equipment.

Disposed on the accumulator and extending vertically upwardly therefrom is a frame structure supporting a horizontally aligned rail. The frame structure further includes at the forward end thereof two triangulated support members which secure a hollow piston rod extending into the interior of the movable cylinder. In this manner the piston rod is aligned above the rail, controlling the articulation of the cylinder therealong. The exposed end of the piston rod supports, in a rotation, a first pulley wheel while the free end of the cylinder is similarly provided with a second pulley wheel. Extending from the exterior of the cylinder, and looped around the first pulley wheel and the second pulley wheel is a chain, such as a sheave chain, the disposition of the second pulley wheel and the chain being aligned within the guide rail. A third pulley wheel, in-plane with the first and second pulley wheels, is supported in rotation on the free end of the piston rod, and it is around this third pulley wheel that the chain is turned to align with the interior of a well bore. Disposed between the interior of the accumulator and the hollow piston rod is a hydraulic pump, electrically driven and reversing in direction according to the switching of two limit switches deployed in the rail. It is these limit switches which control the direction of hydraulic fluid transfer and therefore the direction of the cylinder motion to provide the necessary reciprocating stroke by which pumping is accomplished. Provided further along the rail, in adjustable deployment, are two single action pistons, one at the outer stroke limit to transfer hydraulic fluid out of the toroidal base into a reservoir and the other at the inner stroke limit to transfer fluid in the opposite direction. It is by these pistons that the pneumatic spring level is adjusted to maintain the reciprocating motion within the limit bounds. Thus thermal variations in the pneumatic spring are compensated further whereby in a series of strokes, a balanced state is achieved.

It is to be noted that the foregoing implementation can be conveniently deployed in any radial alignment relative the well bore. The accumulator itself forms the base structure and therefore the necessity of providing foundations and similar fixtures is avoided. In addition the contiguous alignment of the accumulator relative the earth allows for the maintenance of relatively stable temperatures, thus further maintaining the pneumatic spring in substantially constant bias. To this end, it is contemplated to partly bury the accumulator by surrounding it with loose earth, this feature further enhancing the thermal equilibrium sought.

DESCRIPTION OF THE SPECIFIC EMBODIMENT

Figure 1:
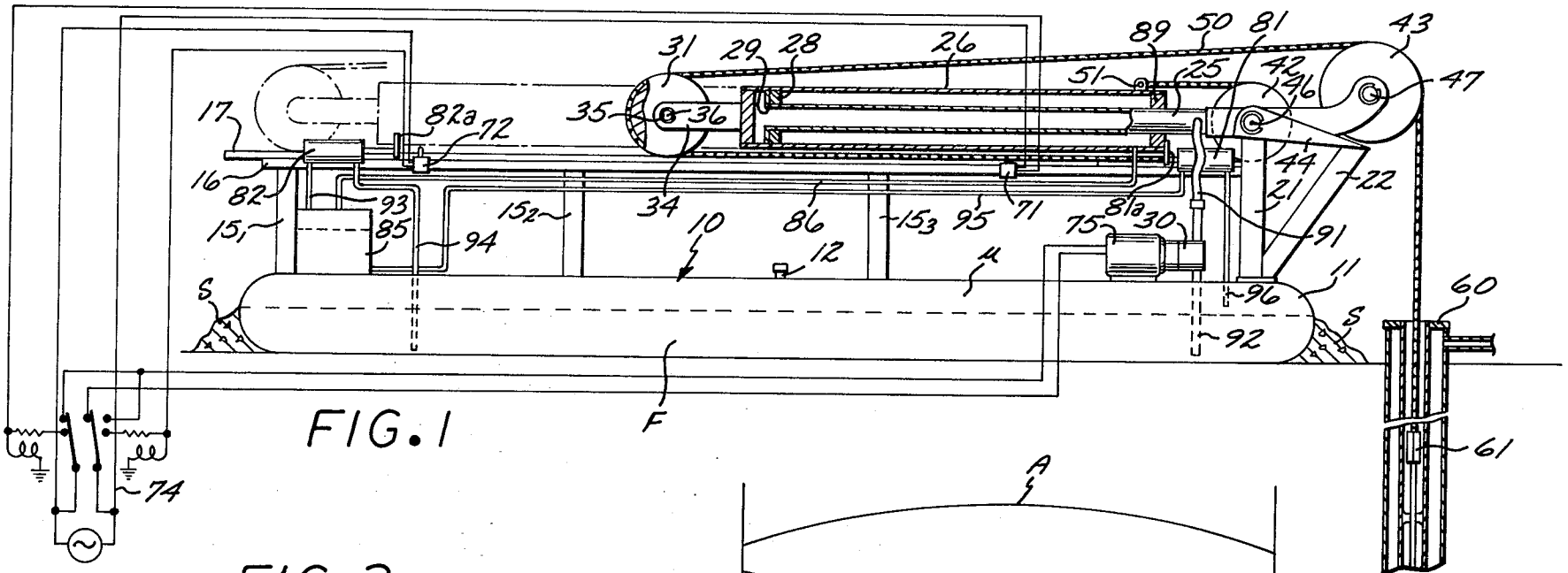
FIG. 1 is a side view, in partial cross-section, of a horizontal pumping unit constructed according to the present invention.
Figure 2:
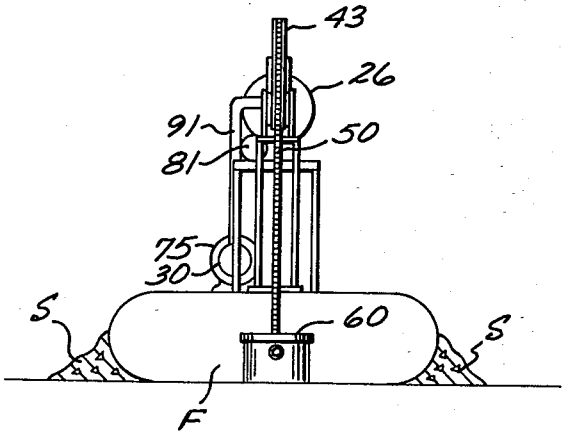
FIG. 2 is a front view of the pumping unit shown in FIG. 1.

As shown in FIGS. 1 and 2 a horizontal pumping unit, generally designated by the numeral 10, comprises a hollow base 11 conformed in a manner of a rectangular toroid to contain a confined volume of selected fluids. More specifically shown contained within the interior cavity of base 11 is a volume of hydraulic fluid F, the base further including the gaseous ullage U which by way of a pressure fitting 12 is pressurized to a predetermined level of compression. For the purposes herein any compressed air source may be utilized to compress the ullage. Extending from the upper surfaces of the base 11 are the plurality of frame members $15_1$ through $15_3$ aligned vertically therefrom to support a platform 16 above the base. Mounted on platform 16 and deployed longitudinally thereon is a channel 17 which forms the guide for the reciprocal motion to be described.

Deployed in front of platform 16 and extending, once more, from the base 11 are two triangulated brace members 21 and 22 connected at the free ends thereof to one end of a hollow piston rod 25 which at the other end is received within a hollow cylinder 26. The alignment of brace members 21 and 22 and the consequent alignment of piston rod 25 are such that the piston rod extends just slightly downwardly above the aforementioned channel 17. To provide for the necessary piston articulation the interior end of piston rod 25 is conformed to include a seal 28 slidably engaging the interior surface of the cylinder 26, seal 28 including a central opening 29 communicating with the hollow interior of the piston rod. An electrically driven hydraulic pump 30 transfers the hydraulic fluid F between the base 11 and the hollow interior of the piston rod 25, thus articulating the cylinder 26 thereon.

The free end of cylinder 26 is, furthermore, provided with a first pulley wheel 31, once more vertically aligned, wheel 31 being deployed for translation within the interior of the guide channel 17. Wheel 31 is supported in rotation at the free end of cylinder 26 between two parallel extensions 34 which terminate in a coaxial opening 35 in which a bearing pin 36 is seated to support the wheel. Similarly the free end of the piston rod 25 is conformed as a split member, again including pins 46 and 47 to support a second wheel 42 and a third wheel 43 therebetween. Once more the deployment of wheels 42 and 43 are coplanar with wheel 31, the pin connections being aligned slightly above the axis of pin 36. Pin 42, furthermore ties the piston rod to a horizontal bracket 44 joining the free ends of members 21 and 22, thus fixing the piston relative the base 11.

Disposed around wheels 31, 42, and 43 is a length of chain such as a sheave chain 50, one end of chain 50 being attached to a securing bracket 51 formed on the exterior of cylinder 26 and the other end of the chain extending into the interior of a well 60 to support pumping apparatus 61 therein. In the configuration shown, chain 50 extends from the bracket 51 around the pulley wheel 42 and is deployed underneath the pulley wheel 31 within the channel 17. By way of the foregoing vertical displacement the chain is free to turn around the pulley wheel 31 and is redirected to the pulley wheel 43 to be turned thereabout to a vertical alignment coaxial with the interior of the bore 60. This deployment of chain 50 provides the requisite mechanical advantage, or multiplication of the stroke length, to achieve pumping.

The direction and duration of fluid transfer through pump 30 is controlled by fore and aft microswitches respectively shown as switches 71 and 72, switches 71 and 72 being tied to the reversing terminals of an electric motor 75 driving the pump 30. More specifically switches 71 and 72 are deployed within the channel 17, switch 71 providing the inward power limit while switch 72 provides the outward power limit.

It is within the gap between the switches 71 and 72 that hydraulic power is applied. Beyond these limits the cylinder 26 is in a coasting mode. To achieve this segmentation of the power stroke switch 71 is tied to unlatch one winding of a double pole double throw relay 74 forming the foregoing reversing terminals of motor 75, while switch 72 unlatches the other terminal. The latching terminals are tied in reverse with the result that the relay 74 is latched in either the forward or reverse mode between the switches only.

In this manner the stroke of cylinder 26 outside of the limit switches 71 and 72 is unpowered. The subsequent stroke excursions are therefore directly related to the inertia of the reciprocating elements and the unbalance between the weight of the downbore equipment 61, and the pneumatic spring or the pressure of the ullage U. While it is possible to reduce the thermal and therefore the pressure variations by accumulations of loose soil S around the base 11 further reduction and compensation of ambient variations is achieved by way of a first and second single action piston pump, respectively shown as pumps 81 and 82, pump 81 being adjustably mounted along the channel 17 distal of switch 71 while pump 82 is similarly mounted distal of switch 72. Pumps 81 and 82 each include an actuating lever 81(*a*) and 82(*a*) respectively deployed for actuation by the cylinder 26 during the overtravel segments of the stroke. The pumping direction of pump 81 is to transfer additional fluid F from a storage container 85 while pump 82 operates in reverse. Thus as the strokes are repeated a balanced state is eventually reached at which the overtravel in both directions is substantially equal.

To further accommodate fluid leakage losses around the seal 28, the interior end of cylinder 26 is provided with yet another seal 89 surrounding the exterior of the piston rod 25, the leakage fluids thus trapped being returned by way of a return line 86 back to the reservoir 85.

Once more, the fluid leakage and the resulting increase in the volume of ullage U are compensated by way of pumps 81 and 82 to achieve a balanced state. The foregoing fluid transfers are achieved by way of a flexible hose 91 connected between pump 30 and rod 25, a pickup tube 92 picking up the fluid F from the interior of base 11 to the pump 30, a return line 93 between pump 82 and reservoir 85, an output line 94 between pump 82 and base 11, a pickup line 95 between pump 81 and reservoir 85 and an input line 96 between pump 81 and the base 11.

Figure 3:
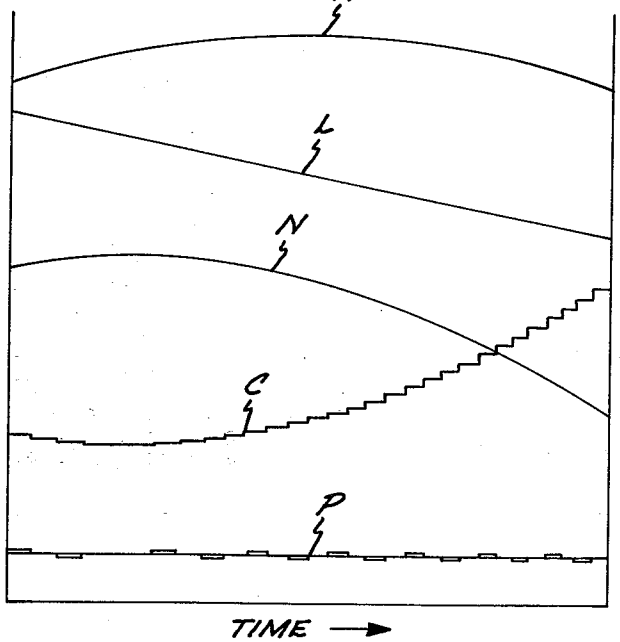
FIG. 3 is a diagrammatic illustration of the reciprocating cycles of the pumping unit disclosed herein.

As shown in FIG. 3, the ullage pressure decrease due to leakage, shown by way of the line L, combines with the daily variations in ambient temperature shown as ullage pressure A in a combined ullage pressure sequence N. This pressure variation is compensated out by way of the stroke steps shown in curve C. The resulting ullage pressure P therefore varies by less than one increment in pressure change out of pumps 81 and 82.

Obviously many modifications and variations to the above disclosure can be made without departing from the spirit of the invention. It is therefore intended that the scope of the invention be determined solely dependent on the claims which follow.

What is claimed is:

1. Apparatus for providing articulating motion, comprising:

container means including an impervious cavity for containing a first quantity of liquid and gas at pressure in the interior thereof;

articulating means operatively connected to said container means for producing mechanical displacement according to the receipt of said liquid therein;

reversible pump means connected between said container and articulating means for transferring said liquid therebetween according to a predetermined position of said mechanical displacement of said articulating means;

reservoir means for storing an additional quantity of said liquid; and compensating means connected between said reservoir means and said container means and aligned to engage said articulating means at a preselected position of said mechanical displacement for transferring said liquid between said container and reservoir means according to the exceedance of said mechanical displacement relative said preselected position.

2. Apparatus according to claim 1 wherein:

said container means includes a substantially toroidal hollow container adapted for substantially horizontal alignment on ground, said container including a pressure fitting in the upper surface thereof for receiving said gas at predetermined pressure; and said articulating means includes a telescoping piston assembly received on the interior of a cylinder, said piston assembly providing said mechanical displacement relative said cylinder according to the receipt of said liquid on the interior of said cylinder.

3. Apparatus according to claim 2 further comprising:

structure means mounted on said container for supporting said articulating means thereon; and pulley means connected between said structure means and said articulating means for providing multiplication of said mechanical displacement.

4. A pneumatically biased articulating system for reciprocating a well pump comprising:

a hollow container adapted for containing a first quantity of liquid and gas at a predetermined pressure;

a hollow cylinder;

a piston assembly slidably received in said cylinder and operatively connected to said container;

a first pump connected between said container and cylinder for transferring said liquid therebetween;

reversing means deployed to engage said cylinder and said first pump for reversing the direction of said liquid transferred therethrough according to the sliding translation of said cylinder on said piston assembly;

a reservoir for storing a second quantity of said liquid; and a second and third pump respectively deployed proximate the limits of the sliding translation of said cylinder on said piston assembly for transferring said liquid between said reservoir and container according to the sliding translation of said cylinder.

5. Apparatus according to claim 4 further comprising:

a pulley system deployed between said cylinder and said well pump.

6. Apparatus according to claim 5 wherein:

said container is adapted for deployment on ground proximate said well pump; and said pulley system includes a turning roller deployable above said well pump.

7. Apparatus according to claim 7 further comprising:

a support structure mounted on the exterior of said container said structure including a substantially horizontal guide channel; and said pulley system includes a first pulley wheel mounted for rotation on the free end of said cylinder, a second pulley wheel mounted for rotation on said piston assembly, said first and second wheels being substantially coplanar with said turning roller, said first wheel being aligned for translation in said guide channel, and a length of hinged chain extending from said cylinder around said first and second wheels and said turning roller to support said well pump therefrom.

8. Apparatus according to claim 7 wherein:

said reversing means includes a first and second switch deployed along said guide channel for articulation by said first pulley wheel; and said first pump includes reversible drive means responsive in direction to the articulation of said first and second switch.

9. Apparatus according to claim 8 wherein:

said second and third pump comprise respectively single action pistons arranged to articulate in opposing direction in response to the translation of said cylinder.

10. A pneumatically biased well pumping system comprising:

a closed container conformed to include a quantity of liquid and gas at a predetermined pressure;

a reciprocating actuator arranged to provide reciprocating mechanical displacement according to the receipt of said liquid therein;

reversible pumping means connected between said container and said actuator for transferring said liquid therebetween according to the mechanical displacement of said actuator; and compensating means connected to said container and deployed to engage said actuator for adjusting said quantity of said liquid in said container according to the exceedance of said mechanical displacement beyond a predetermined displacement dimension.

11. Apparatus according to claim 10 further comprising:

structure means connected to said actuator; and pulley means deployed between said actuator and structure means for multiplying said mechanical displacement.

12. Apparatus according to claim 11 wherein:

said actuator includes a piston slidably received within a cylinder for producing said mechanical displacement according to the receipt of said liquid therebetween; and said pulley means includes a hinged chain extending in looped arrangement between said cylinder and said structure means.

* * * * *